United States Patent [19]

Sorwick et al.

[11] Patent Number: 4,905,916

[45] Date of Patent: Mar. 6, 1990

[54] SYRINGE DISPOSAL APPARATUS AND METHOD

[75] Inventors: Jack R. Sorwick, Parker; Thomas Pearce, Littleton, both of Colo.; Paul Welborn, Battleground, Ind.; David E. Wood, Englewood; David B. Swezey, Denver, both of Colo.

[73] Assignee: National Syringe Disposal, Inc., Englewood, Colo.

[21] Appl. No.: 316,465

[22] Filed: Feb. 27, 1989

[51] Int. Cl.[4] ..... B02C 19/14

[52] U.S. Cl. ..... 241/23; 241/65; 241/99

[58] Field of Search ..... 241/99, 23, 101.2, 65, 241/34

[56] References Cited

U.S. PATENT DOCUMENTS 3,589,276 6/1971 Swallert .
3,683,733 8/1972 Johan et al. .
3,750,966 8/1973 Anderson .
3,756,520 9/1973 Hughes .
3,926,379 12/1975 Dryden et al. .
3,929,295 12/1975 Montalbano .
3,958,765 5/1976 Musselman .
4,406,571 9/1983 Ross .
4,466,538 8/1984 Gianni .
4,488,643 12/1984 Pepper .
4,545,540 10/1985 Nakamura .
4,565,311 1/1986 Pugliese et al. .
4,576,281 3/1986 Kirksey .
4,618,103 10/1986 Wilson et al. .
4,619,409 10/1986 Harper et al. .
4,662,516 5/1987 Baker et al. .

*Primary Examiner*—Mark Rosenbaum
*Attorney, Agent, or Firm*—Thomas S. Birney

[57] ABSTRACT

A syringe disposal apparatus has a portable collection unit and a process unit. The collection unit has an in-feed mechanism to allow syringes to be introduced into the collection unit; and an interlock mechanism suitable for removably securing the collection unit to the processing unit and emptying the syringes from the collection unit into the processing unit. The processing unit contains an interlock mechanism suitable to activating the collection unit interlock mechanism; a grinder suitable for grinding the syringes into particles of metal and plastic; and a crucible assembly suitable for heating these particles above the melting point of plastic, and then cooling to produce a solid puck of plastic in which the metal particles are suspended and encapsulated.

5 Claims, 12 Drawing Sheets

SYRINGE DISPOSAL APPARATUS AND METHOD

BACKGROUND OF THE INVENTION

1. Field of the Invention

The present invention relates generally to the field of devices employed to dispose of used syringes, and in particular to devices used to collect and then grind up and melt used syringes.

2. Statement of the Problem

Hypodermic syringes are widely used in hospitals and other medical facilities for a variety of purposes, including, for example, drawing of blood and other patient fluid samples, and for administration of medication. Such hypodermic syringes are commonly provided as individually prepackaged, sterilized, disposable items intended for use a single time after which they are discarded, thereby avoiding relatively costly and time-consuming re-sterilization. However, disposal of used syringes must be accomplished in a manner that safely avoids injury to medical personnel, such as inadvertent needle punctures and potentially contaminating contact with the used syringe. In particular, it is imperative to minimize exposure of medical personnel to dangerous organisms such as HIV and hepatitis viruses that may be present in used syringes. It is also highly desirable to dispose of used syringes in a manner that minimizes the opportunity or risk of unauthorized reuse, for example, by drug abusers. Finally, improper disposal of medical waste poses a danger to the general public.

A number of devices and processes have been invented in the past to deal with disposal of used syringes and needles, including the following:

| Inventor | Patent No. | Issue Date |
|---|---|---|
| Swallert | 3,589,276 | Jun. 29, 1971 |
| Anderson | 3,750,966 | Aug. 7, 1973 |
| Baker, et al. | 4,662,516 | May 5, 1987 |
| Gianni | 4,466,538 | Aug. 21, 1984 |
| Dryden, et al. | 3,926,379 | Dec. 16, 1975 |
| Hughes | 3,756,520 | Sept. 4, 1973 |
| Nakamura | 4,545,540 | Oct. 8, 1985 |
| Pepper | 4,488,643 | Dec. 18, 1984 |
| Musselman | 3,958,765 | May 25, 1976 |
| Montalbano | 3,929,295 | Dec. 30, 1975 |
| Johan, et al. | 3,683,733 | Aug. 15, 1972 |
| Ross | 4,406,571 | Sep. 27, 1983 |
| Harper, et al. | 4,619,409 | Oct. 28, 1986 |
| Pugliese, et al. | 4,565,311 | Jan. 21, 1986 |
| Wilson, et al. | 4,618,103 | Oct. 21, 1986 |
| Kirksey | 4,576,281 | Mar. 18, 1986 |

Swallert discloses an apparatus for destruction of hospital waste comprising a grinder which grinds the waste into small particles or powder, and a device for heat sterilization and compression of the powder into briquettes.

Anderson discloses a grinding device with a pair of counter-rotating toothed rolls which can fracture a syringe into a plurality of discrete pieces.

Baker, et al, disclose a wall-mounted collection container for used syringes. The top surface of the unit has a convolved opening through which syringes are collected in a thermoplastic liner inside the unit. The liner and its contents are periodically removed from the unit and heated in the course of sterilization to melt the liner around the debris.

Gianni discloses a portable disposal bottle for hypodermic needles. The bottle has a cap assembly designed to facilitate dropping used needles into the bottle in an orientation to optimize its numerical capacity. Kirksey shows another approach to this problem.

Dryden, et al., disclose a syringe disintegrator in which syringes are milled into particles and treated with a liquid disinfectant. Wilson shows another variation of this same general type.

Pepper discloses a collection container for used syringes having a flexible, resilient one-way valve to allow insertion of the syringe into the container while preventing re-emergence of the syringe from the container.

Musselman discloses a type of syringe and needle grinder.

Montalbano discloses a grinder for destroying syringes. An in-feed mechanism insures that each syringe is properly aligned to enter the grinder. FIGS. 10 through 12 show an alternative embodiment in which a pivotably mounted receptacle 84 accepts a syringe and then rotates to drop the syringe into the grinder.

Johan, et al., disclose a mechanism for cutting individual hypodermic needles to prevent their reuse. Pugliese, et al., disclose another variation in which the syringe is cut into two pieces.

Harper, et al, disclose a large-scale hospital waste disposal system with a dual conveyor arrangement to provide positive delivery of large waste containers to a disintegrator comprised of two large counterrotating hammer mills.

The Hughes, Nakamura, and Ross references are only of passing interest.

Solution to the Problem

None of the prior art references uncovered in the search show a two-part syringe disposal apparatus having a processing unit and a separate portable collection unit that can be easily carried from room to room in a health care facility to collect used syringes. A single processing unit at a central location is then used to process the used syringes gathered by the collection units. The collection unit has an in-feed mechanism to allow used syringes to be individually fed into the unit, and an interlock mechanism adapted to removably secure the collection unit to the processing unit for the purpose of emptying syringes from the collection unit without further exposure to medical personnel. After being emptied into the processing unit, the syringes are first ground up, and the resulting particles of metal, plastic, and rubber are then heated beyond the melting point of the plastic to form a solid puck in which the metal particles are suspended and encapsulated. The heating process also sufficient to sterilize the particles and eliminate any microorganisms that were present.

SUMMARY OF THE INVENTION

This invention provides a syringe disposal apparatus having a separate portable collection unit and a processing unit. The collection unit has an in-feed mechanism to allow syringes to be individually introduced into the collection unit; and an interlock mechanism suitable for removably securing the collection unit to the processing unit and emptying the syringes from the collection unit into the processing unit. The processing unit contains an interlock mechanism suitable to activating the collection unit interlock mechanism; a grinder suitable for grinding the syringes into particles of metal, plastic, and rubber; and a crucible assembly suitable for heating these particles above the melting point of plastic, and then cooling to produce a solid puck of plastic in which the metal particles are suspended and encapsulated.

A primary object of the present invention is to provide an apparatus for destruction and decontamination of used syringes that minimizes the risk of accidental injury or infection to medical personnel.

Another object of the present invention is provide a small portable in-room unit for collection of used syringes that is cost-effective and easy to use.

Yet another object of the present invention is to convert used syringes into a form (i.e. a solid plastic puck encapsulating the metal fragments from the needle) that can be safely discarded without risk to the general public.

These and other advantages, features, and objects of the present invention will be more readily understood in view of the following detailed description and the drawings.

BRIEF DESCRIPTION OF THE DRAWINGS

The present invention can be more readily understood in conjunction with the accompanying drawings, in which.

DETAILED DESCRIPTION OF THE INVENTION

Figure 2:
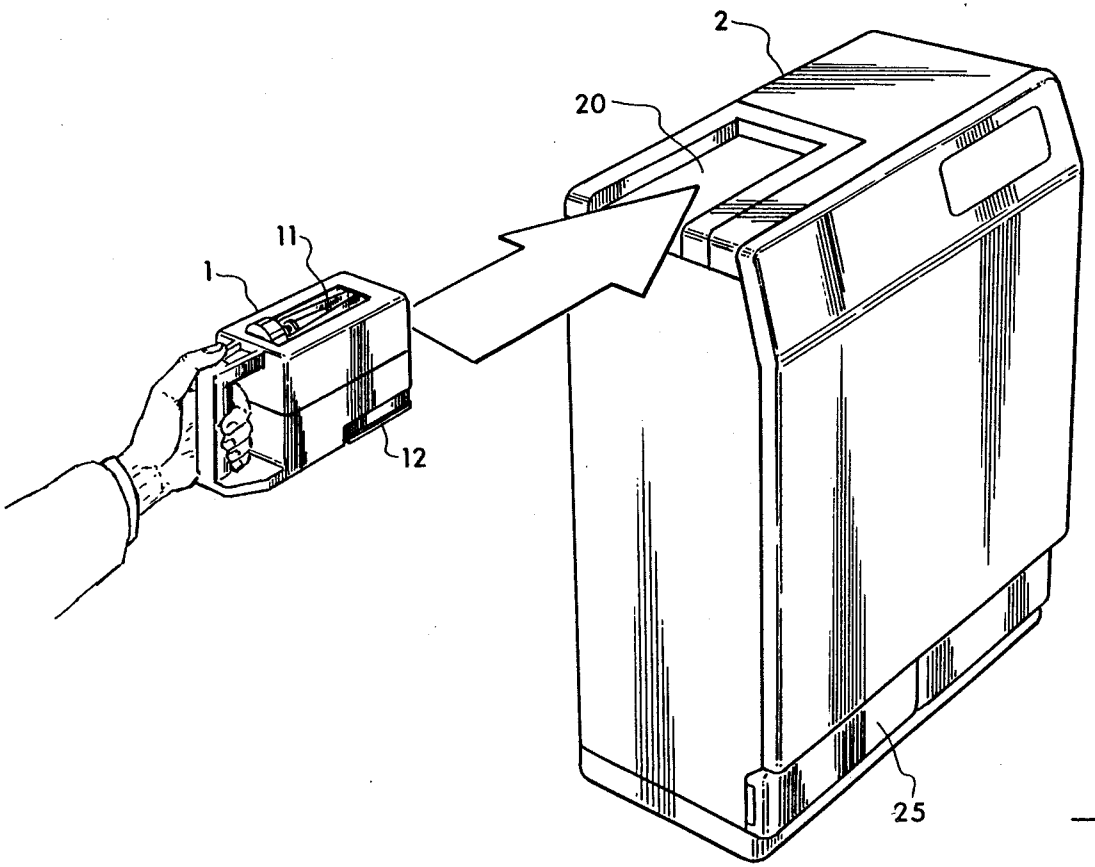
FIG. 2 is a perspective view showing the manner in which the collection unit is inserted into the processing unit.
Figure 6:
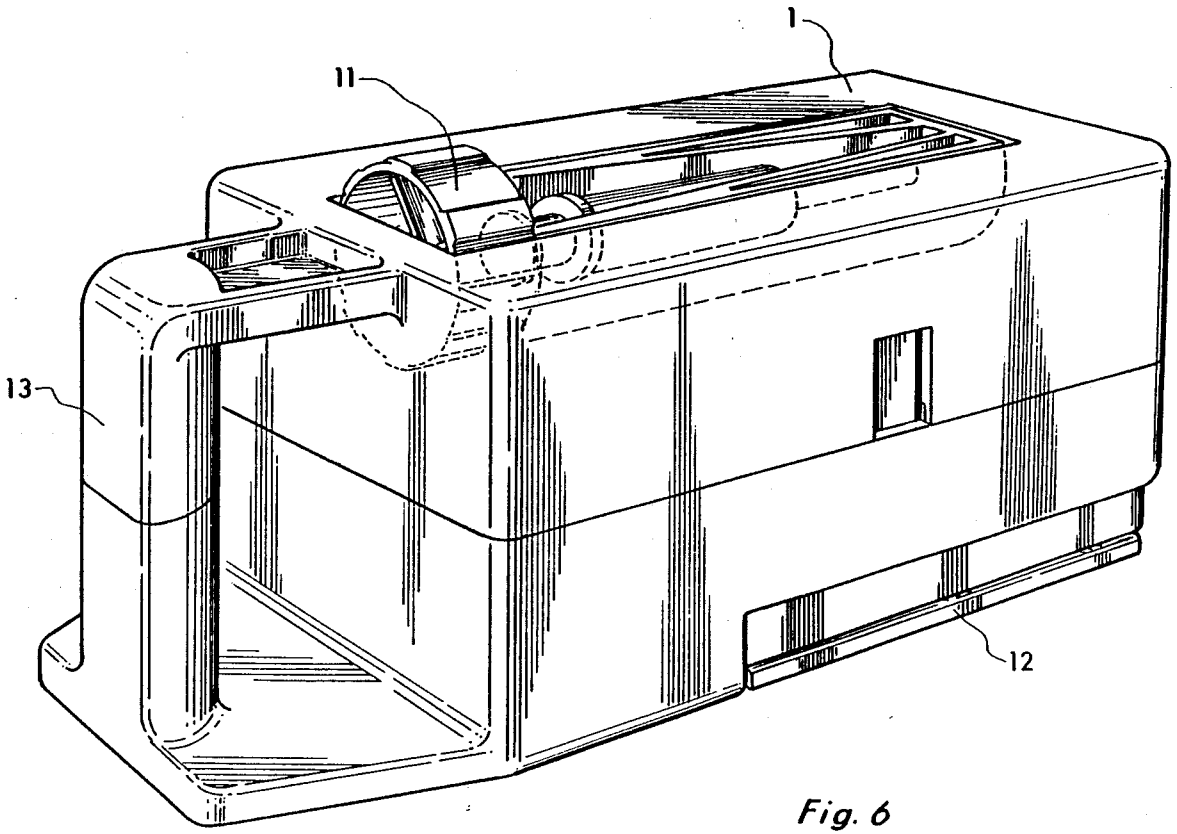
FIG. 6 is a perspective view of the collection unit.
Figure 7:
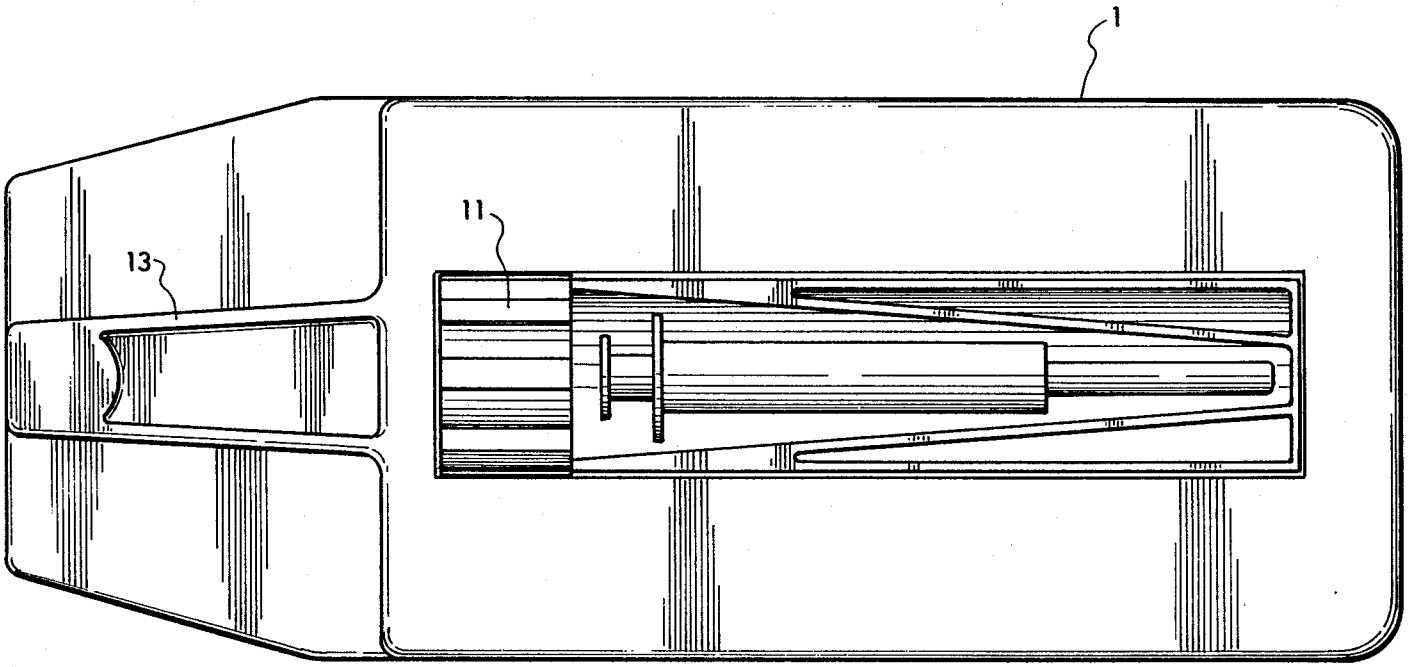
FIG. 7 is a top view of the collection unit.
Figure 8:
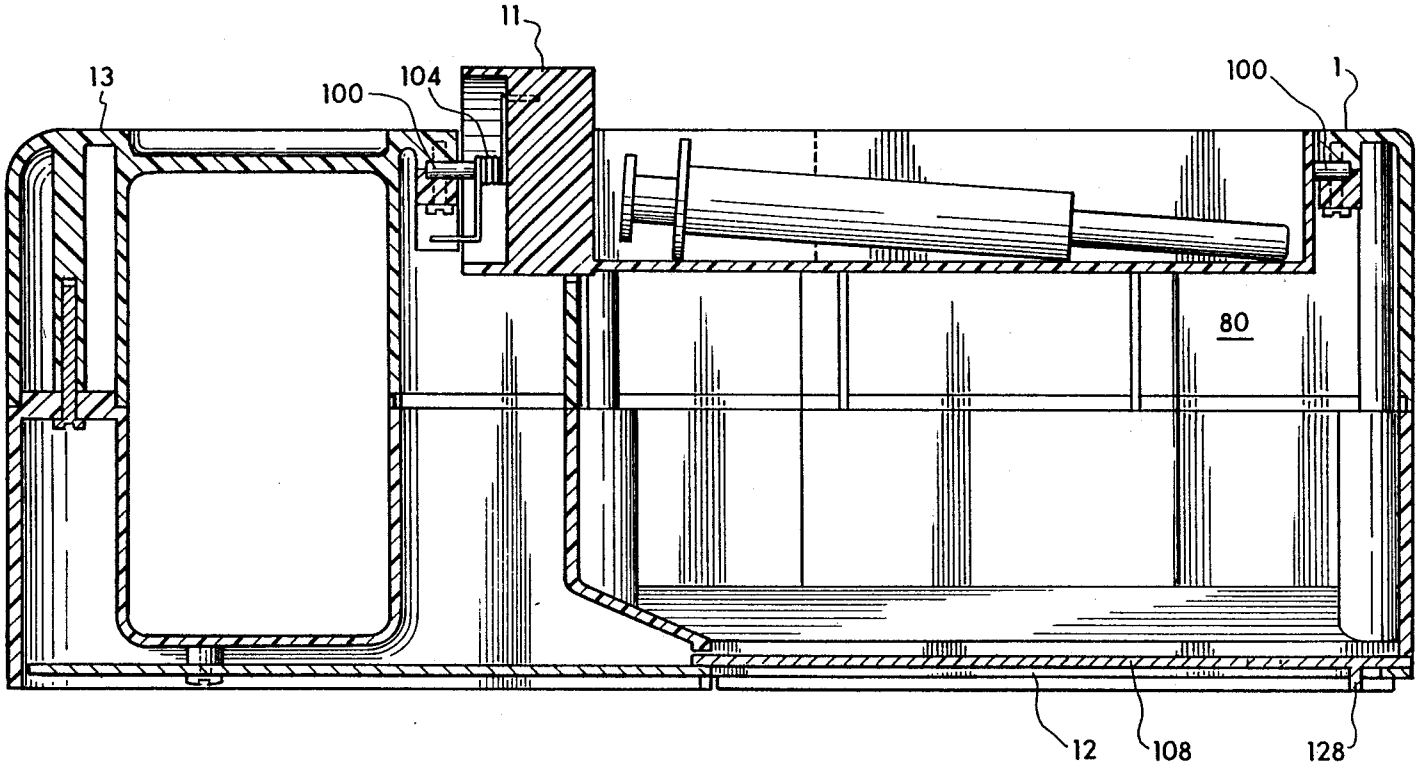
FIG. 8 is a vertical cross-sectional view of the collection unit.
Figure 10:
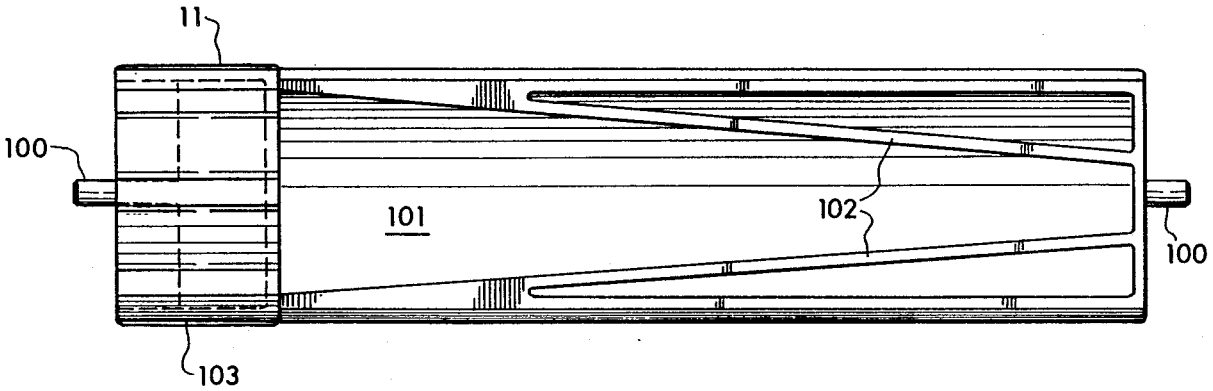
FIG. 10 is a top view of the rotatable door corresponding to FIG. 9.
Figure 9:
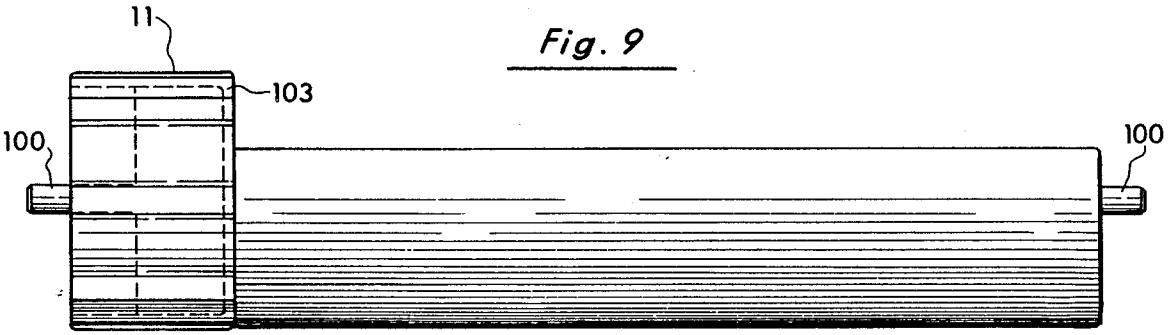
FIG. 9 is a side view of the rotatable door used to introduce syringes into the collector unit.
Figure 11:
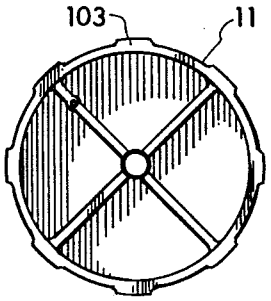
FIG. 11 is an end view of the rotatable door corresponding to FIG. 9.

Turning to FIG. 2, the collection unit 1 and processing unit 2, which comprise the apparatus, are shown in perspective view. As shown in greater detail in FIGS. 6 through 8, the collection unit 1 is a small, portable container that can be easily carried from room to room in a hospital to gather used syringes. One end of the collection unit 1 serves as a convenient handle 13 for carrying the unit. The top of the collection unit has an in-feed mechanism in the form of a rotatable door 11 that allows syringes to be individually fed into the internal chamber 80 of the unit. The in-feed mechanism is shown in greater detail in FIGS. 9 through 11. The rotatable door 11 has a generally cylindrical configuration, with a portion of the exterior of the cylinder cut away to form a receptacle 101 for receiving individual syringes. Two tapered guides 102 extend diagonally along a portion of the length of this receptacle 101 to create a trapezoidal cross-section for the receptacle, and thereby insure that syringes can only be placed into the receptacle with the needle of the syringe pointing away from the handle 13. The rotatable door 11 is rotatably secured over a corresponding opening in the top of the collection unit 1 by means of two hinge pins 100 that are seated in holes in the collection unit's casing. After a syringe has been placed in the receptacle 101, the rotatable door 11 is manually rotated by means of a thumb wheel 103 to an inverted position. The syringe falls by gravity from the receptacle 101 into the interior chamber 80 of the collection unit. The rotatable door 11 is then returned to its initial position by a return spring 104 to accept the next syringe. The length and cylindrical diameter of the rotatable door are only slightly smaller than the length and width of this opening. Thus, any syringes held in the collection unit can not easily reemerge through this opening, regardless of the position of the rotatable door.

The bottom of the collection unit has an interlock mechanism 12 which can be triggered to empty the syringes from the collection unit. The interlock mechanism is specifically designed to be tamper-resistant and to minimize the risk of accidental activation.

Figure 1:
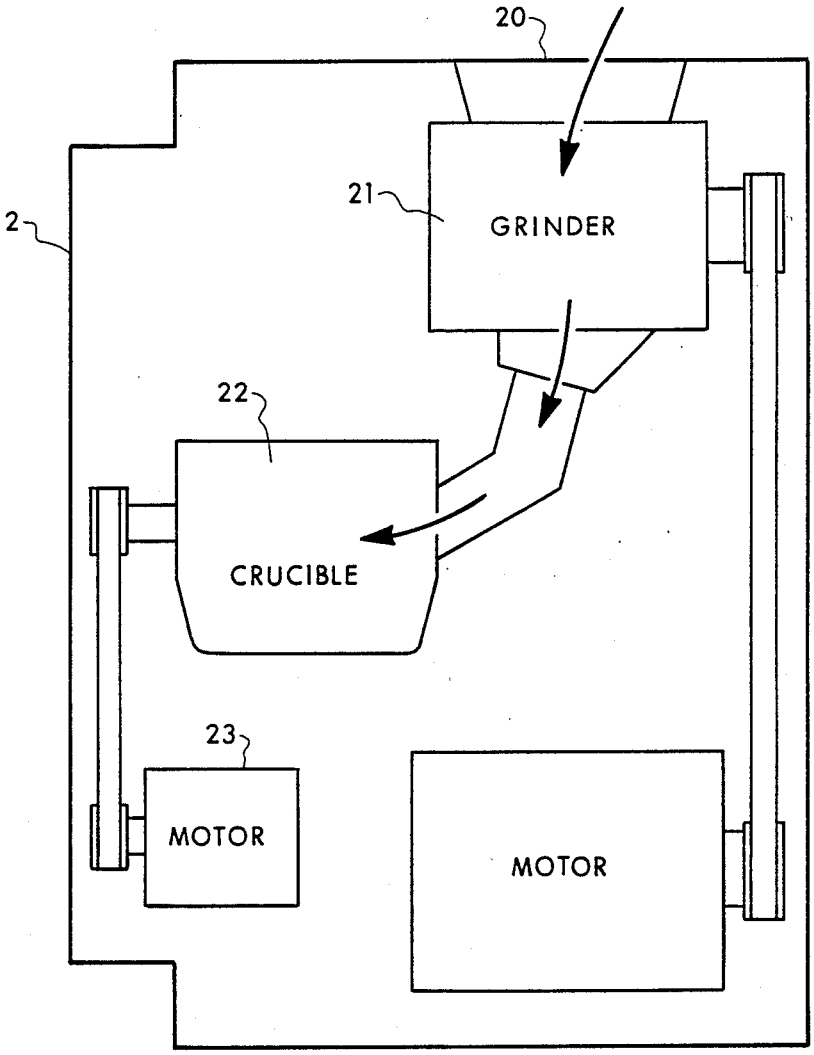
FIG. 1 is a simplified side view of the processing unit.

The processing unit 2 has a modular housing to protect its internal components. These components are shown in simplified schematic form in FIG. 1. A corresponding interlock mechanism 20 located on the top of the processing unit 2 interfaces with the interlock mechanism 12 on the collection unit 1 to unlock and open corresponding sliding doors on both units. These interlock mechanisms 12 and 20 are activated by sliding the collection unit 1 into place with respect to the processing unit 2, as shown in FIGS. 2, 3, 13 and 14. All of the used syringes contained in the interior chamber 80 are allowed to fall out of the collection unit and into the processing unit.

Figure 12:
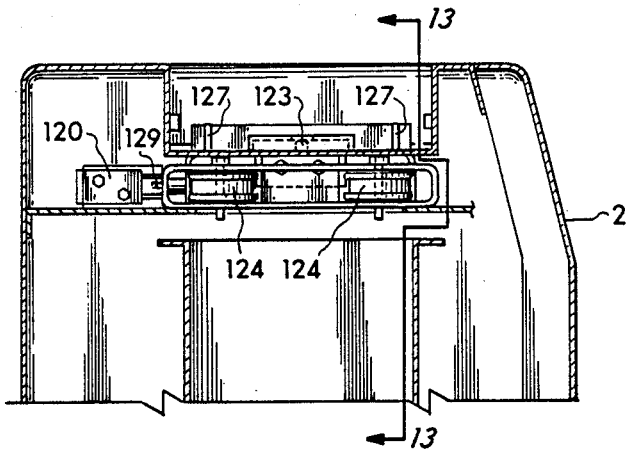
FIG. 12 is an end cross-sectional view showing the interlock mechanism at the upper left corner of the processing unit.
Figure 13:
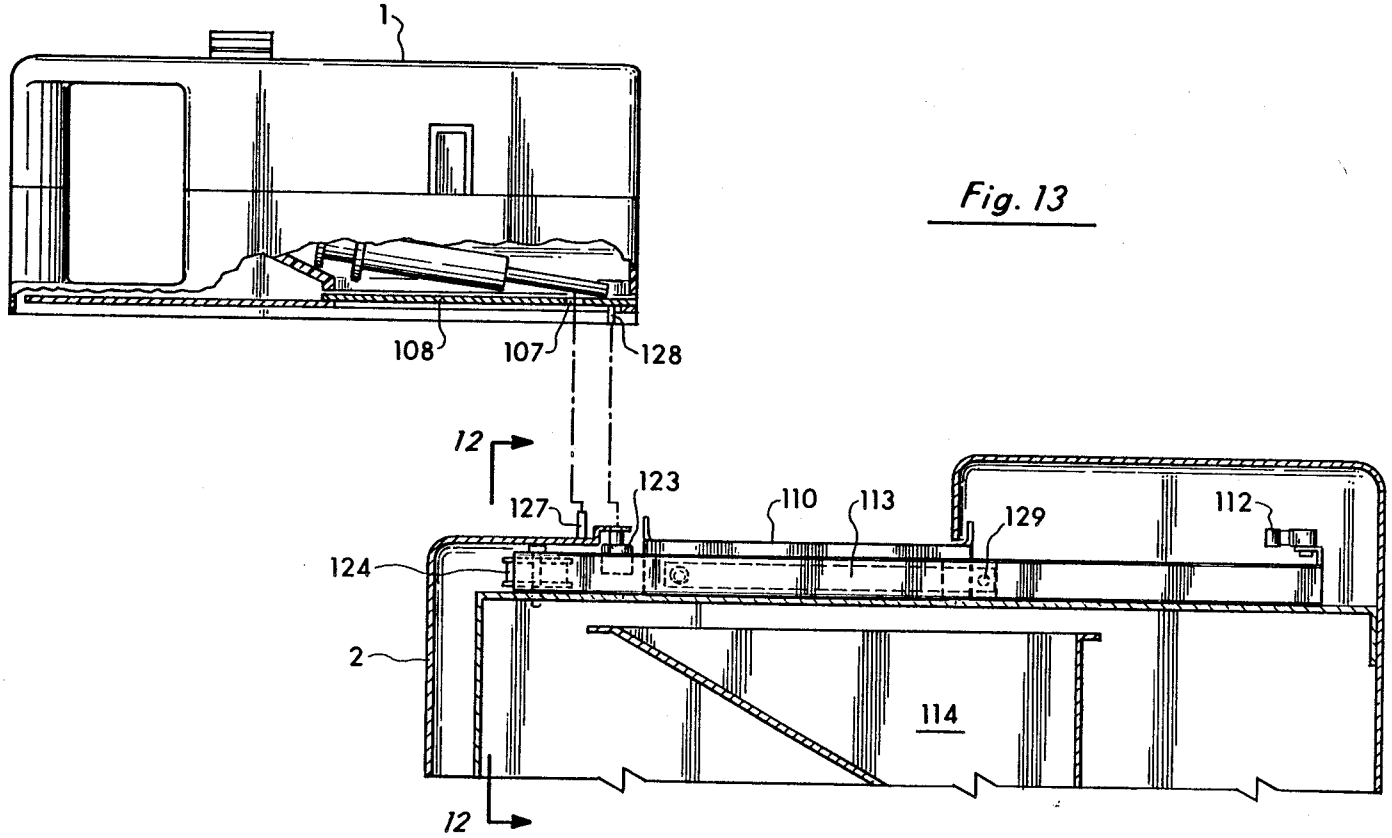
FIG. 13 is a side cross-sectional view generally corresponding to FIG. 12 showing the interlock mechanisms of the collection unit and the processing unit prior to initial engagement of the units.
Figure 14:
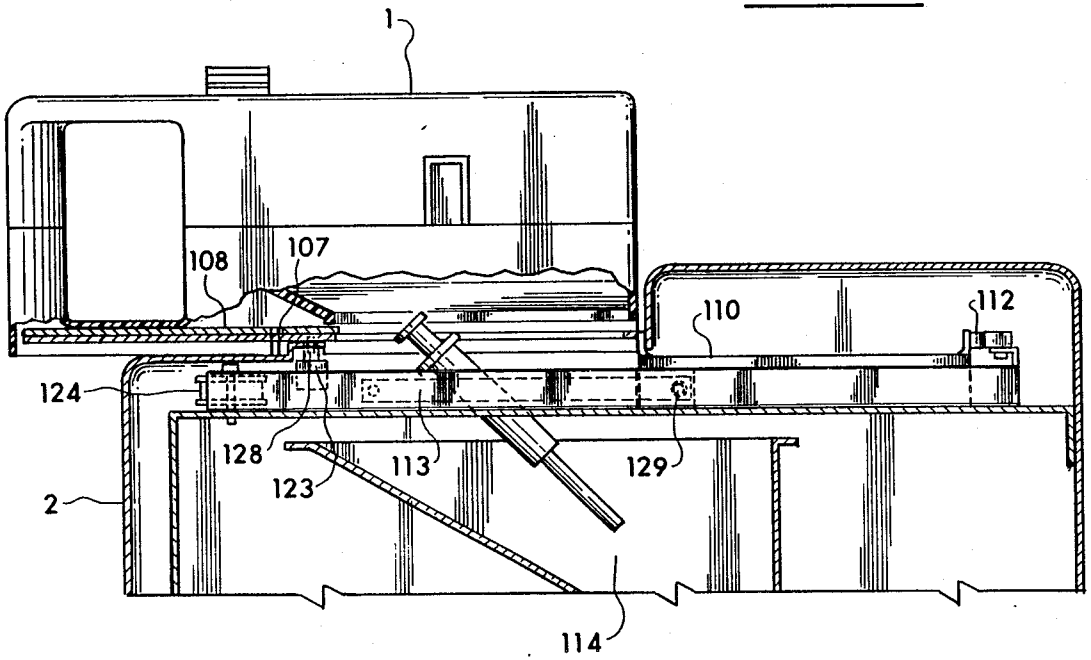
FIG. 14 is a side cross-sectional view generally corresponding to FIG. 13 showing the interlock mechanisms of the collection unit and the processing unit after engagement of the units.

The interlock mechanisms of the preferred embodiment of the present invention are shown in greater detail in FIGS. 12 through 14. After a sufficient quantity of syringes have been collected, the collection unit 1 is gradually lowered by the user onto the interlock mechanism 20 on the upper left corner of the processing unit. Longitudinal slots in the bottom surface of the collection unit guide the entry of two engagement pins 127 extending upward from the processing unit 2 into corresponding holes 107 in the sliding door 108 in the bottom of the collection unit 1. These pins 127 arrest motion of the collection unit door 108 relative to the processing unit 2, and simultaneously upwardly displace two latch springs located inside the collection unit to allow the door 108 to slide longitudinally with respect the bottom of the collection unit 1.

Figure 3:
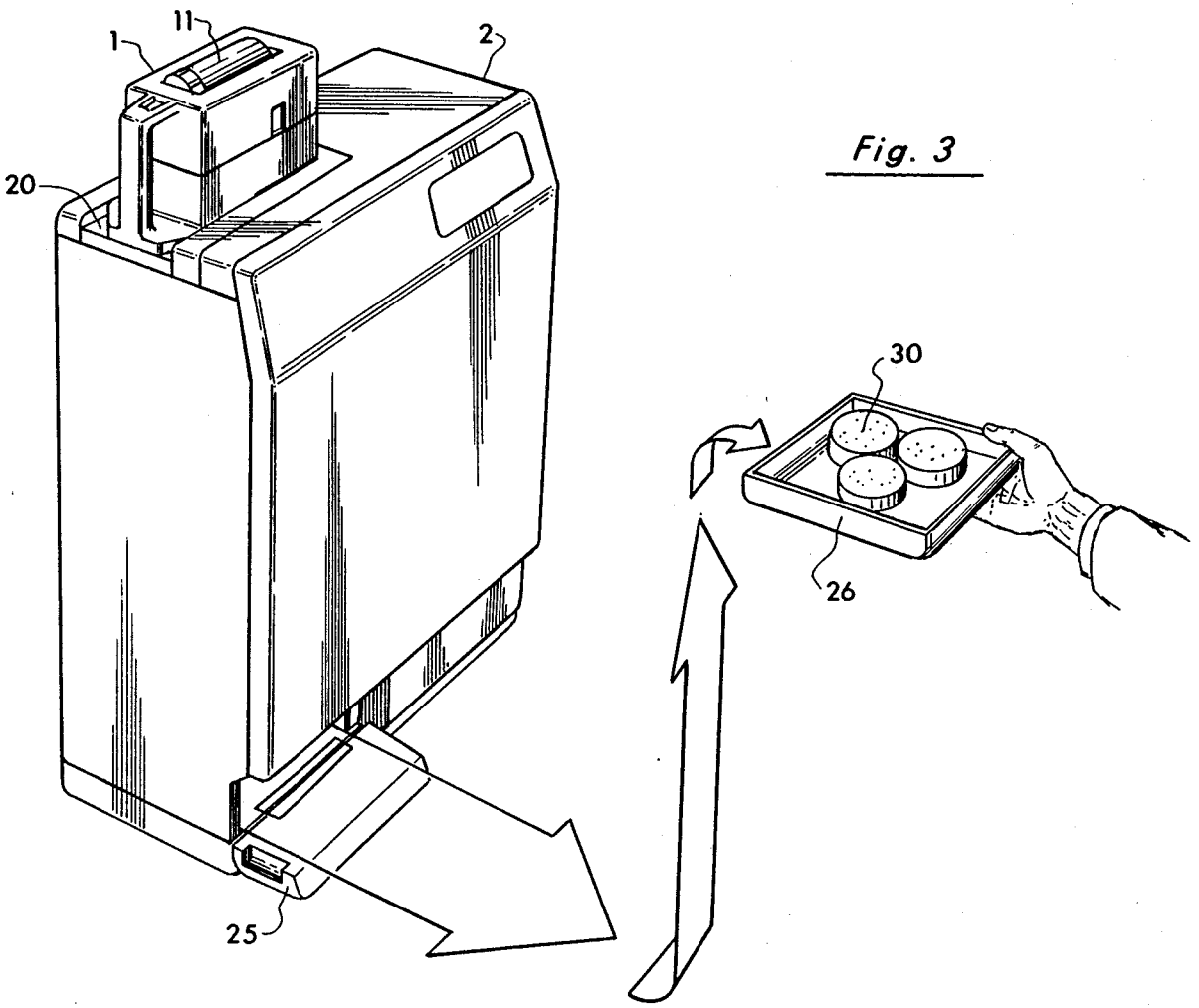
FIG. 3 is a perspective view showing the collection unit inserted into the processing unit, and also showing the manner in which a tray holding several processed pucks of melted plastic and metal particles resulting from the disposal process is removed through an access door in the bottom of the processing unit.

A second sliding door 110, located on the top of the processing unit 2, covers the in-feed chute to the grinder 21. This door 110 is generally locked in a shut position by a solenoid-activated locking pin 129. Simultaneous with the preceding engagement, a third engagement pin 128 extending downward from the collection unit door 108, enters downward through a small hole in processing unit and depresses the actuating button on a limit switch 123 inside the housing of the processing unit 2. This energizes a solenoid 120 which causes the pin 129 to retract, thereby unlocking the door 110 on the top of the processing unit 2. As shown in FIGS. 13 and 14, the collection unit 1 is then pushed laterally forward by the user against the exposed end of the processing unit door 110. This door 110 slides laterally to the right into the processing unit as the collection unit advances. Since the collection unit door 108 is restrained by the engagement pins 127, an opening is created between the collection unit 1 and the processing unit 2 as the collection unit is pushed forward into the processing unit. The syringes stored in the collection unit fall through this opening and into the in-feed chute 114 for the grinder 21 located within the processing unit 2. During this operation, any transverse motion of the collection unit with respect to the processing unit is constrained by the vertical side walls of the processing unit's interlock mechanism as shown in FIGS. 2, 3, and 12.

When the collection unit 1 is fully inserted into the processing unit 2, the distal end of the processing unit door 110 makes contact with a second limit switch 112. This switch interrupts power to the solenoid 120, causing the spring-loaded locking pin 129 to be pressed against the side of the processing unit's door slide assembly 113. The collection unit can then be withdrawn from the processing unit by lifting it vertically upward off the processing unit. Two constant-force spring assemblies 124 exert a longitudinal force to the processing unit door 110 to drive it to a closed and locked position. When this door 110 is fully closed, the spring-loaded locking pin 129 drops into the shallow recess of the door slide assembly 113 and prevents further movement of the processing unit door. In addition, spring latches in the bottom of the collection unit close and lock the sliding door 108 in the collection unit.

As a safety feature, limit switch 123 remains deactivated until completion of the entire processing cycle. This prevents a collection unit from being inserted into the processing unit due to engagement of the locking pin 129 with the recess in the processing unit door slide assembly 113.

After the contents of the collection unit are emptied into the processing unit, a grinder 21 contained in the processing unit 2 is activated to grind the syringes into particles or small fragments. In one embodiment, a solenoid-activated trap door (not shown) located at the bottom of the in-feed chute retains the syringes in the chute until the grinder is up to full operating speed. The trap door is then opened, allowing the syringes to drop into the grinder.

Most conventional disposable syringes have a metal needle, but the remaining components are usually made of a thermoplastic material, such as polypropylene. In addition, a small amount of other elastomeric material, such as rubber, may be used for the plunger seal. Thus, the ground material produced by the grinder are largely particles of plastic. Only about 5% of these particles are metal fragments or other materials.

These particles are fed from the grinder into a crucible 22. In the preferred embodiment, an electric heating element built into the crucible is then employed to raise the temperature of the crucible and its contents to approximately 450° F. to sterilize the contents of the crucible 22 and melt the plastic particles into a molten mass. The melting point of polypropylene is approximately 340° F. The metal particles in the crucible are suspended and encapsulated in the melted plastic. In the preferred embodiment, this process requires about 20 minutes using a 600 watt heater. Virtually any type of conventional heater could be substituted.

Figure 4:
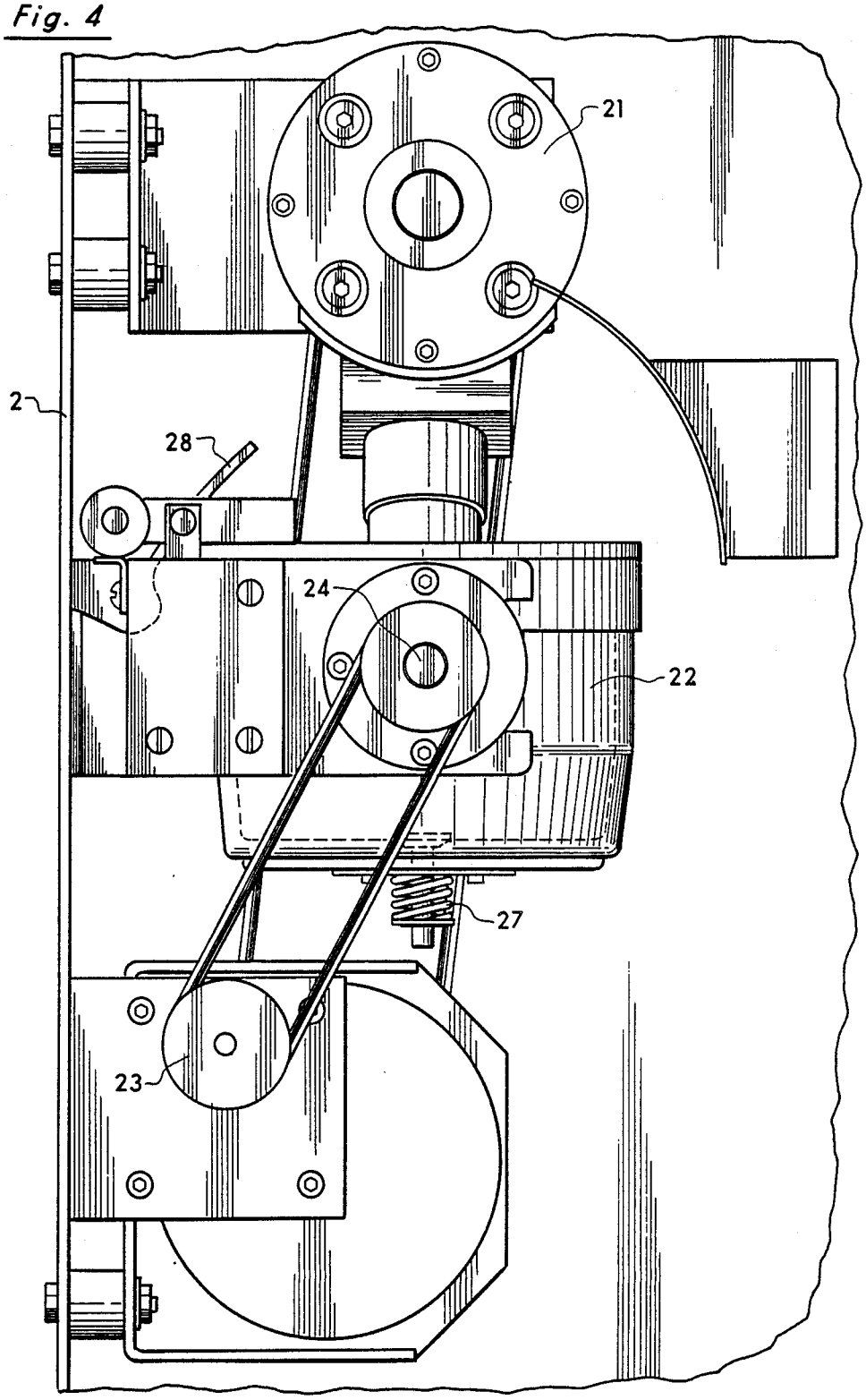
FIG. 4 is a side view showing the crucible assembly in an upright position within the processing unit.
Figure 5:
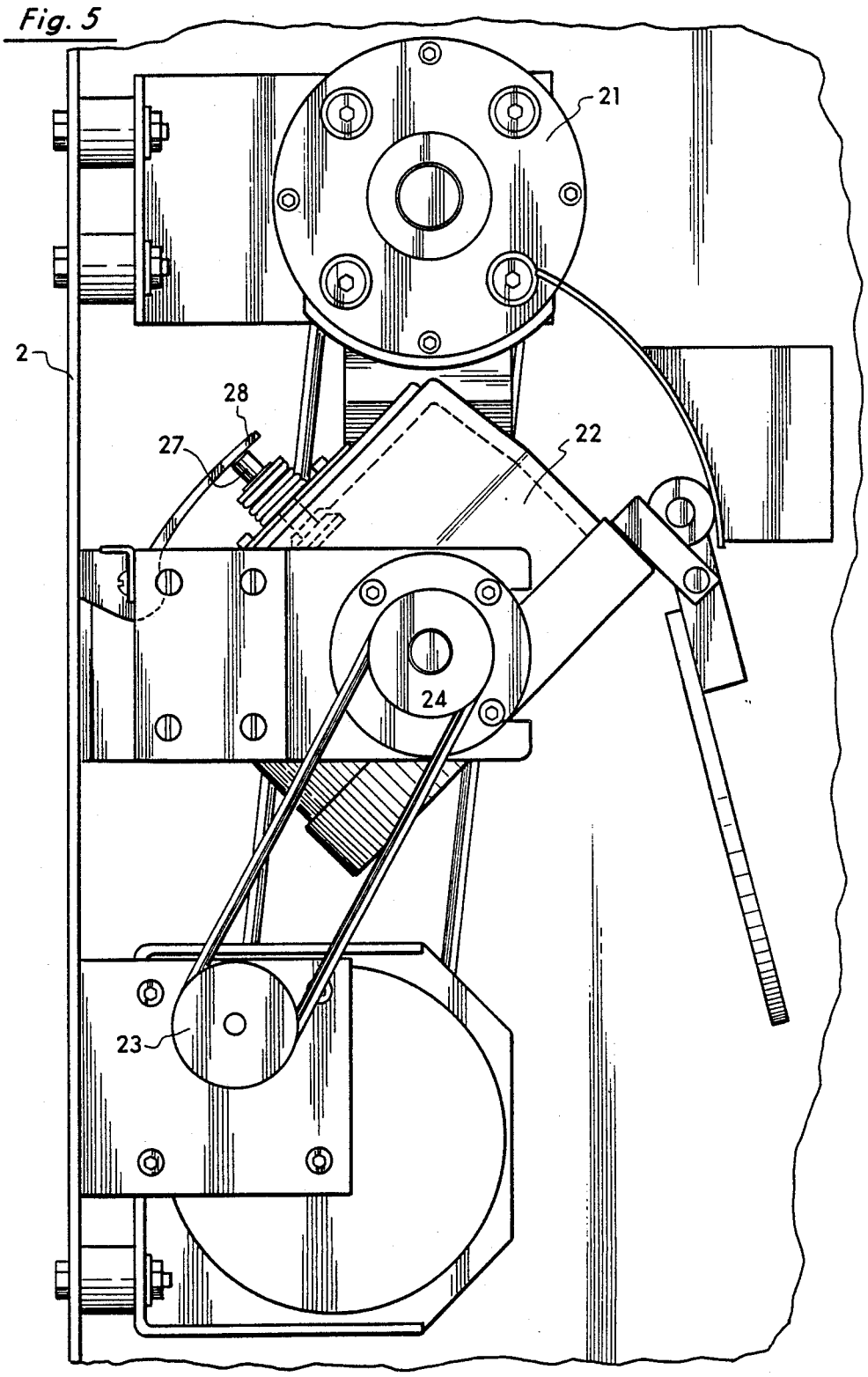
FIG. 5 is a side view showing the crucible assembly in a rotated position within the processing unit.

After the plastic particles have melted, the heater is turned off and the contents of the crucible are allowed to cool to a temperature below the melting point of the plastic to form a solid puck. Surprisingly, experimentation indicates that few, if any, of the metal particles are found at or near the surface of the plastic puck. Thus, the sharp edges of the metal particles are safely encapsulated within the puck. The crucible 22 is pivotably mounted by means of bearings 24 to the housing of the processing unit 2, so that the crucible can be tipped or rotated about a horizontal axis into an inverted position to allow the puck to fall out of the crucible. A motor 23 controls rotation of the crucible 22. FIG. 4 shows the crucible 22 in an upright position. FIG. 5 shows the crucible in its inverted position. To help insure elimination of the puck from the crucible at the end of each operating cycle, a spring-loaded "knock out" pin 27 extends from the interior to the exterior of the crucible through a small hole in the bottom surface of the crucible. The outer end of the pin extends substantially outward beyond the bottom surface of the crucible. A caming surface 28, attached to the housing, contacts the outer end of the pin 27 when the crucible is in an inverted position, thereby moving the pin inward with respect to the crucible, and exerting a positive force on the bottom of the puck to cause it to fall out of the crucible. The puck falls into a tray at the bottom of unit. FIG. 3 shows a tray 26 holding several pucks 30 resulting from the disposal process being removed through an access door 25 in the bottom of the processing unit 2.

The preceding discussion has been primarily limited to disposal of plastic syringes. It should be noted that the present invention is readily adaptable to disposal of types of medical wastes composed primarily of plastics, such as disposable scalpels.

The above disclosure sets forth a number of embodiments of the present invention. Other arrangements or embodiments, not precisely set forth, could be practiced under the teachings of the present invention and as set forth in the following claims.

We claim:

1. An apparatus for disposal of used syringes consisting primarily of plastic components and a metal needle, said apparatus comprising:

(a) a grinder suitable for grinding said syringes into particles of metal and plastic; and (b) a crucible assembly which receives said particles produced by said grinder, having:

(1) a heater adapted to heat said crucible and said particles to a temperature above the melting point of said plastic particles, and then allow said crucible and its contents to cool to a temperature below said melting point to produce a solid puck of plastic in which the metal particles are suspended and encapsulated; and (2) rotation means adapted to rotate said crucible about a horizontal axis into an inverted position to cause said puck to fall out of said crucible assembly.

2. An apparatus for disposal of used syringes consisting primarily of plastic components and a metal needle, said apparatus comprising:

(a) a portable collection unit having
  (1) an interior collection chamber;
  (2) an in-feed mechanism to allow syringes to be introduced into said collection chamber; and
  (3) an interlock mechanism adapted to empty the syringes from said collection chamber; and (b) a processing unit having
  (1) a grinder suitable for grinding said syringes into particles of metal and plastic;
  (2) an interlock mechanism adapted to activate the collection unit interlock mechanism and cause the syringes contained in said collection unit to empty into said grinder; and
  (3) a crucible assembly which receives said particles produced by said grinder, heats said particles to a temperature above the melting point of the plastic particles, and is then cooled to a temperature below said melting point to produce a solid puck of plastic in which the metal particles are suspended and encapsulated.

3. An apparatus for disposal of used syringes consisting primarily of plastic components and a metal needle, said apparatus comprising:

(a) a portable collection unit having
  (1) an interior collection chamber;
  (2) an in-feed mechanism to allow syringes to be introduced into said collection chamber; and
  (3) an interlock mechanism adapted to empty the syringes from said collection chamber; and (b) a processing unit having
  (1) a grinder suitable for grinding said syringes into particles of metal and plastic;
  (2) an interlock mechanism adapted to activate the collection unit interlock mechanism and cause the syringes contained in said collection unit to empty into said grinder; and
  (3) a crucible assembly which receives said particles produced by said grinder; heats said particles to a temperature above the melting point of said plastic particles; is then cooled to a temperature below said melting point to produce a solid puck of plastic in which the metal particles are suspended and encapsulated; and is then rotated about a horizontal axis to cause said puck to fall out of said crucible assembly.

4. A method for disposal of used syringes consisting primarily of plastic components and a metal needle, said method comprising the following steps:

(a) grinding said syringes into particles of metal and plastic;
(b) heating said particles in a crucible to a temperature above the melting point of said plastic particles;
(c) cooling the contents of said crucible to produce a solid puck of plastic in which the metal particles are suspended and encapsulated; and
(d) rotating said crucible about a horizontal axis to cause said puck to fall out of said crucible.

5. An apparatus for disposal of used syringes consisting primarily of plastic components and a metal needle, said apparatus comprising:

(a) a housing;
(b) a grinder within said housing suitable for grinding said syringes into particles of metal and plastic; and
(c) a crucible assembly within said housing having:
  (1) a crucible having a side wall and a bottom wall forming a container which receives and contains said particles produced by said grinder;
  (2) a heater adapted to heat said crucible and said particles contained therein to a temperature above the melting point of said plastic particles for a predetermined period of time, and then allow said crucible and its contents to cool to a temperature below said melting point to produce a solid puck of plastic in which said metal particles are suspended and encapsulated;
  (3) rotation means adapted to rotate said crucible about a horizontal axis into an inverted position;
  (4) a movable pin extending from the interior to the exterior of said crucible through a hole in the bottom surface of said crucible, with one end of said pin extending outward beyond said bottom surface;
  (5) a caming surface attached to said housing, and adapted to contact the outward end of said pin when said crucible is in an inverted position, and move said pin inward with respect to said crucible, thereby causing said puck to fall out of said crucible.

* * * * *